US007344415B2

(12) United States Patent
Inaba et al.

(10) Patent No.: US 7,344,415 B2
(45) Date of Patent: Mar. 18, 2008

(54) FUSE BLOCK

(75) Inventors: Tatsuya Inaba, Kakegawa (JP); Yuichiro Goto, Kakegawa (JP); Masahiro Kawazu, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/396,473

(22) Filed: Apr. 4, 2006

(65) Prior Publication Data

US 2006/0258223 A1 Nov. 16, 2006

(30) Foreign Application Priority Data

Apr. 4, 2005 (JP) ..... P2005-107322

(51) Int. Cl.
*H01R 13/68* (2006.01)

(52) U.S. Cl. ..... 439/620.34; 439/620.27; 337/198; 337/194

(58) Field of Classification Search ..... 439/620.34, 439/620.27, 620.26; 337/198, 194, 216
See application file for complete search history.

(56) References Cited

U.S. PATENT DOCUMENTS 5,221,217 A * 6/1993 Oikawa ..... 439/620.27
5,488,345 A * 1/1996 Seki et al. ..... 337/186
5,632,654 A * 5/1997 Sugiura ..... 439/620.26
5,662,496 A * 9/1997 Kanamori ..... 439/620.27
5,680,088 A * 10/1997 Seki et al. ..... 337/194
5,751,208 A * 5/1998 Martinez ..... 337/198
6,059,609 A * 5/2000 Nieto ..... 439/620.27
6,666,722 B2 * 12/2003 Fukumori et al. ..... 439/620.26
2002/0115347 A1 * 8/2002 Fukumori et al. ..... 439/621

FOREIGN PATENT DOCUMENTS

JP 5-342919 A 12/1993
JP 7-169382 A 7/1995
JP 8-195161 A 7/1996

* cited by examiner

*Primary Examiner*—Gary F. Paumen
(74) *Attorney, Agent, or Firm*—Sughrue Mion, PLLC

(57) ABSTRACT

There is provided a fuse block 3 having an insertion port 7 into which a dark current fuse 11 is inserted and adapted to hold the dark current fuse 11 in a mount position, and the fuse block includes a guide surface 8 which is formed within the insertion port 7 in such a manner as to continue from the mount position for the dark current fuse 11 for contact with the dark current fuse 11 and arms formed at positions lying at lateral sides of the dark current fuse 11 in such a manner as to face the insertion port 7 so as to be able to hold the dark current fuse 11 therein when the dark current fuse 11 is in contact with the guide surface 8.

9 Claims, 4 Drawing Sheets

FUSE BLOCK

BACKGROUND OF THE INVENTION

1. Field of the Invention

The present invention relates to a fuse block which is formed in part of an automotive electric junction box for holding a dark current fuse at a mount position.

2. Description of the Related Art

A fuse block which is formed in part of an automotive electric junction box for holding a dark current fuse at a mount position where the dark current fuse is connected to connecting terminals needs to hold the dark current fuse in such a manner as to be changed over between an in-use state and a non-use state, and in the non-use state, the dark current fuse needs to be kept separated from the connecting terminals accommodated within the fuse block in order to prevent the loss thereof.

Since a fuse for a normal circuit stays mounted in a fuse block without being removed therefrom for life, the fuse block only has to have a construction which can protect the fuse from an external force, and no fuse holder has to be used for the fuse. On the contrary, in the event of the dark current fuse which is handled to be mounted and demounted, a fuse holder is used which is separated from the fuse block and which accommodates the dark current fuse therein in order to hold the dark current fuse when not in use and for the sake of operability when the in-use state and the non-use state are changed over (refer to JP-A-5-342979 (claims 1, 2, paragraphs 0006, 0008 to 0010, 0012 to 0014, FIGS. 1, 4), JP-A-7-169382 (claims 1, 2, 7, paragraphs 0006 to 0009, 0014 to 0016, FIGS. 1 to 5), and JP-A8-195161 (claim 1, paragraphs 0008, 0010 to 0017, FIGS. 2, 5).)

In the cited document Nos. 1 to 3, there is provided an advantage where with a dark current fuse mounted in a fuse holder, a changeover between the in-use state and the non-use state can be effected only by mounting and demounting the fuse holder on and from a fuse block without handling the dark current fuse directly.

However, when the dark current fuse is neither changed over to the non-use state again nor is used for various purposes repeatedly after it has once been connected to connecting terminals, the fuse holder is merely needed temporarily and is disposed as a waste material after the use. Thus, the fuse holder itself becomes a useless, wasteful part.

In addition, when the fuse holder is used, a projection needs to be formed on a side of the fuse block so as to allow the fuse holder to be supported on the fuse block, while an opening or notch needs to be formed on a side of the fuse holder so as to be locked on the projection, and this complicates the production of the fuse block and the fuse holder.

SUMMARY OF THE INVENTION

The invention was made in these situations, and an object thereof is to propose a fuse block which can eliminate the production of parts to be discarded by imparting the fuse block a function to hold a dark current fuse when it is not in use.

With a view to accomplishing the object, according to a first aspect of the invention, there is provided a fuse block having an insertion port into which a dark current fuse is inserted and adapted to hold the dark current fuse in a mount position, the fuse block including a guide surface which is formed within the insertion port in such a manner as to continue from the mount position for the dark current fuse for contact with the dark current fuse and arms formed at positions lying at lateral sides of the dark current fuse in such a manner as to face the insertion port so as to be able to hold the dark current fuse therein when the dark current fuse is in contact with the guide surface.

The dark current fuse is allowed to be inserted into the insertion port so as to be brought into contact with the guide surface, as well as be held in the position where terminals of the dark current fuse are not connected to connecting terminals by forming the guide surface within the insertion port of the fuse block and forming the arms at the positions lying at the lateral sides of the dark current fuse in such a manner as to face the insertion port so as to be able to hold the dark current fuse therein. Namely, since the fuse block can maintain the dark current fuse in such a state that the dark current fuse is separated from the connecting terminals, the necessity of using a fuse holder is obviated which is adapted to hold the dark current fuse in the non-use state. In the first aspect of the invention, nothing is discussed on a means for holding the dark current fuse by the arms, and any means is included which effects the holding of the dark current fuse through contact, adhesion, locking, engagement and the like.

By obviating the necessity of the fuse holder, a part to be discarded is reduced by one, and one of production losses is eliminated. In addition, since the formation of the projection on the fuse block which is required in association with the use of the fuse holder is no more required, the production of the fuse block is simplified, and together with the advantage where the one part that is conventionally required is no more require, a reduction in production cost can be realized.

Since the guide surface with which the dark current fuse is brought into contact is formed within the insertion port in such a manner as to continue from the mount position of the dark current fuse, the dark current fuse can be shifted from a temporary hold position where the dark current fuse is in contact with the guide surface to the mount position by simply traveling along the guide surface. Namely, since the dark current fuse which is in the temporary hold state is allowed to reach the mount state only by being simply pushed in, there is caused no deterioration in operability by using no fuse holder. In addition, since the mount position of the dark current fuse is situated at a position in the fuse block which is deeper than a temporary hold position where the dark current fuse is temporarily held and which is reached when the dark current fuse is pushed deeper than the temporary hold position, where the dark current fuse is protected from an external force by virtue of the existence of the side walls which make up the insertion port, no further treatment is required to protect the dark current fuse in the mount state.

According to a second aspect of the invention, there is provided a fuse block as set forth in the first aspect of the invention, wherein a distance between respective inner circumferential surfaces of the opposing arms is slightly small than a width of a portion of the dark current fuse which is held by both the arms.

Since the arms are formed at the positions lying to the lateral sides of the dark current fuse in such a manner as to face the insertion port, so as to be deformed elastically at an insertion port end of the fuse block where the fuse block is opened, when the dark current fuse is inserted into the insertion port to thereby be brought into contact with the arms at portions where the dark current fuse is to be held by the arms, the arms are slightly deformed elastically widthwise of the dark current fuse in both directions due to the distance between the respective inner circumferential surfaces of the arms being smaller than the width of the dark current fuse according to the second aspect of the invention.

Since the arms constitute a pair lying across the dark current fuse widthwise, in the temporary hold state in which the dark current fuse is in contact with the guide surface, the arms hold the dark current fuse in such a state that the dark current fuse is compressed widthwise by the restoration force thereof, so as to stabilize the dark current fuse against dislodgement from the insertion port. By being so stabilized against the dislodgement from the insertion port, the dark current fuse is maintained in the temporary hold state within the fuse block.

According to a third aspect of the invention, there is provided a fuse block as set forth in the first or second aspect of the invention, a projection adapted to catch and hold the dark current fuse in a thickness direction thereof in cooperation with the guide surface is formed on at least either of surfaces of the arms which are opposite to each other in such a manner as to project towards the dark current fuse. The projection is formed on either or both of the two opposing arms in such a state that the projection is in contact or can be brought into contact with the surface of the dark current fuse.

According to the third aspect of the invention, since, by forming the projection on the surfaces of the arms which are opposite to each other in such a manner as to catch the dark current fuse in the thickness direction, the projection restrains the movement of the dark current fuse in the thickness direction to thereby stabilize it, together with the dislodgement restraining effect by the main bodies of the arms, the stabilization of the dark current fuse in such a state that it is in contact with the guide surface is increased. In the event that the projection is formed on each of the two arms, the restraining effect in the thickness direction can be increased.

According to a fourth aspect of the invention, there is provided fuse block as set forth in the third aspect of the invention, wherein a distance between a surface or point on a side of the projection which lies to the guide surface and the guide surface is slightly smaller than the thickness of a portion of the dark current fuse which is caught by the projection and the guide surface.

In this case, since the distance between the surface or point (including a line) on the side of the projection which lies to the guide surface and the guide surface is slightly smaller than the thickness of the dark current fuse, the arms are slightly deformed elastically towards the surface of the dark current fuse in the thickness direction thereof when the projection is brought into contact with the surface of the dark current fuse. By being so deformed elastically, the arms compress the dark current fuse in the thickness direction so as to press it towards the guide surface to thereby restrain the movement of the dark current fuse in the thickness direction, the stability of the dark current fuse in the temporary hold state being thereby enhanced.

According to a fifth aspect of the invention, there is provided a fuse block as set forth in any of the first to fourth aspects of the invention, wherein the arms are formed by making notches partially in side walls which face the insertion port. The side walls lie at both lateral sides of the dark current fuse in the temporary hold state, and the arms face each other across the dark current fuse widthwise.

Since the arms only have to have the function to be able to hold the dark current fuse when the dark current fuse is in contact with the guide surface, there is imposed no specific limitation on how to form the arms, however, according to the fifth aspect of the invention, since part of the side walls can be used to hold the dark current fuse by making notches partially in the side walls so as to form the arms, the form of the fuse block can be simplified compared to a case where arms are formed in any other portions of the fuse block than the side walls.

According to a sixth aspect of the invention, there is provided a fuse block as set forth in any of the first to fifth aspects of the invention, having at the mount position for the dark current fuse an inner wall which is able to hold the dark current fuse at the mount position, wherein a surface of the inner wall continues to the guide surface. Since the surface of the inner wall holds the dark current fuse in such a state that terminals of the dark current fuse are connected to connecting terminals accommodated within the fuse block, the surface of the inner wall constitutes a vertical plane or a plane which is close thereto.

In this case, since the surface of the inner wall which can hold the dark current fuse in the mount position continues to the guide surface, a shift from the temporary hold state in which the dark current fuse is in contact with the guide surface to the mount state in which the dark current fuse is connected to the connecting terminals can be effected only by simply pushing the dark current fuse further, and hence, the work of shifting the dark current fuse from the temporary hold state to the mount state can be simplified.

According to a seventh aspect of the invention, there is provided a fuse block as set forth in the sixth aspect of the invention, having a securing wall which is able to hold the dark current fuse at the mount position in cooperation with the inner wall, wherein a distance between respective opposing faces of the inner wall and the securing wall is slightly smaller than the thickness of a portion of the dark current fuse which is caught be the inner wall and the securing wall, and wherein at least either of the inner wall and the securing wall can be deformed elastically.

In this case, due to the distance between the respective opposing faces of the inner wall and the securing wall being slightly smaller than the thickness of the dark current fuse and due to at least either of the inner wall and the securing wall being able to be deformed elastically, the inner wall and the securing wall catch the dark current fuse in the thickness direction in the mount position so as to restrain the movement of the dark current fuse in the relevant direction, the stability of the dark current fuse in the mount state being thereby increased.

According to an eighth aspect of the invention, there is provided a fuse block as set forth in the sixth or seventh aspect of the invention, wherein the guide surface is inclined relative to the surface of the inner wall.

In shifting the dark current fuse from the temporary hold state to the mount state, while the guide surface can be positioned on, for example, the same plane (a vertical plane) as the surface of the inner wall, according to the eighth aspect of the invention, the height of ahead portion of the dark current fuse is lowered with the dark current fuse held temporarily due to the guide surface being inclined relative to the surface of the inner wall, thereby making it possible to suppress the height of the fuse block. In addition, since the temporarily held dark current fuse is supported on the guide surface which is inclined relative to the vertical plane, the load to be borne by the arms when they hold the dark current fuse is made small compared to a case where the guide surface constitutes a vertical plane.

As has been described above, in the invention, since the dark current fuse can be maintained in such a state that the fuse is separated from the connecting terminals by forming the guide surface with which the dark current fuse is brought into contact within the insertion port into which the dark current fuse is inserted and forming the arms which are able to hold the dark current fuse at the positions lying at the lateral sides of the dark current fuse, the necessity of using the fuse holder is obviated which is adapted to hold the dark current fuse when it is not in use.

As a result, since a part that is eventually discarded is no more required, one of the production losses can be eliminated. In addition, since the formation of the projection on the fuse block which is required in association with the use of the fuse holder is no more required, the production of the fuse block is simplified, leading to a reduction in production cost.

DESCRIPTION OF THE PREFERRED EMBODIMENTS

A best mode for carrying out the invention will be described below using the accompanying drawings.

Figure 1:
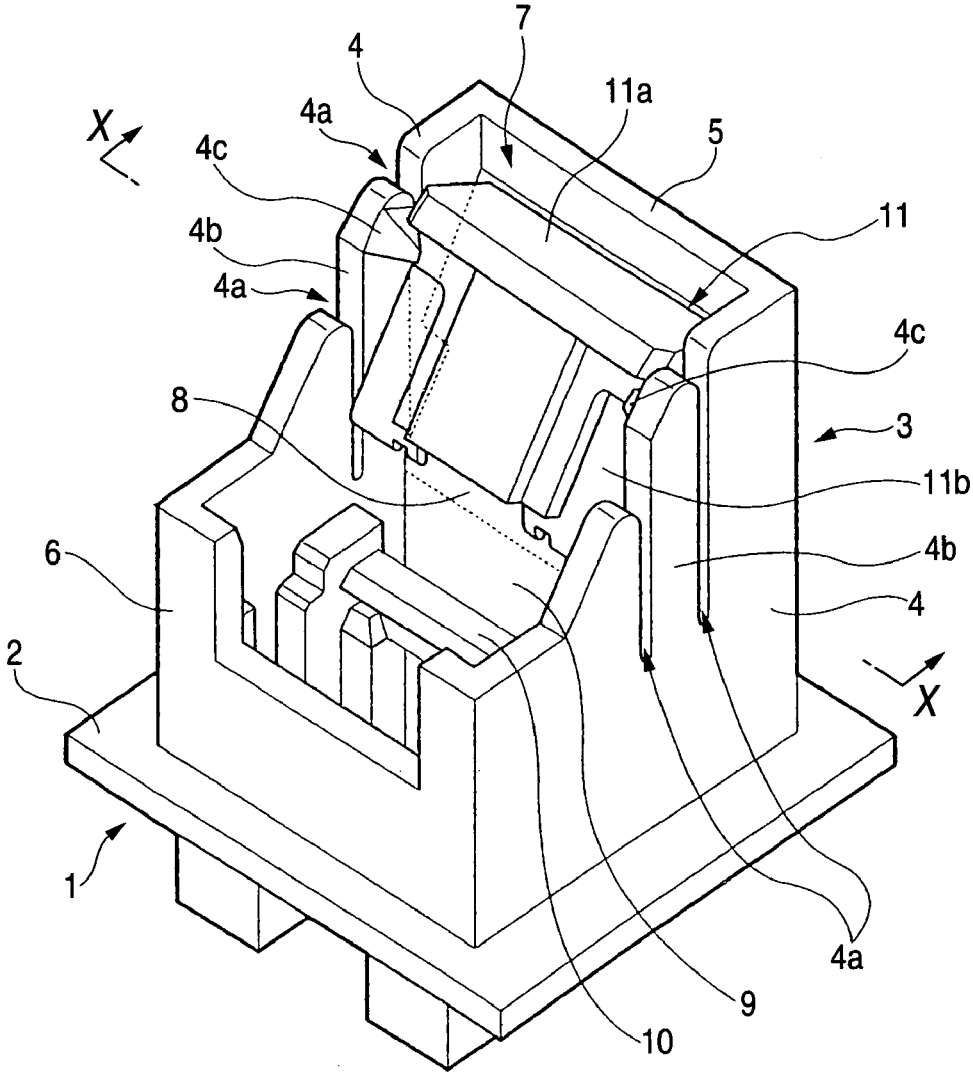
FIG. 1 is a perspective view which shows a state in which a dark current fuse is temporarily held in a fuse block.
Figure 2:
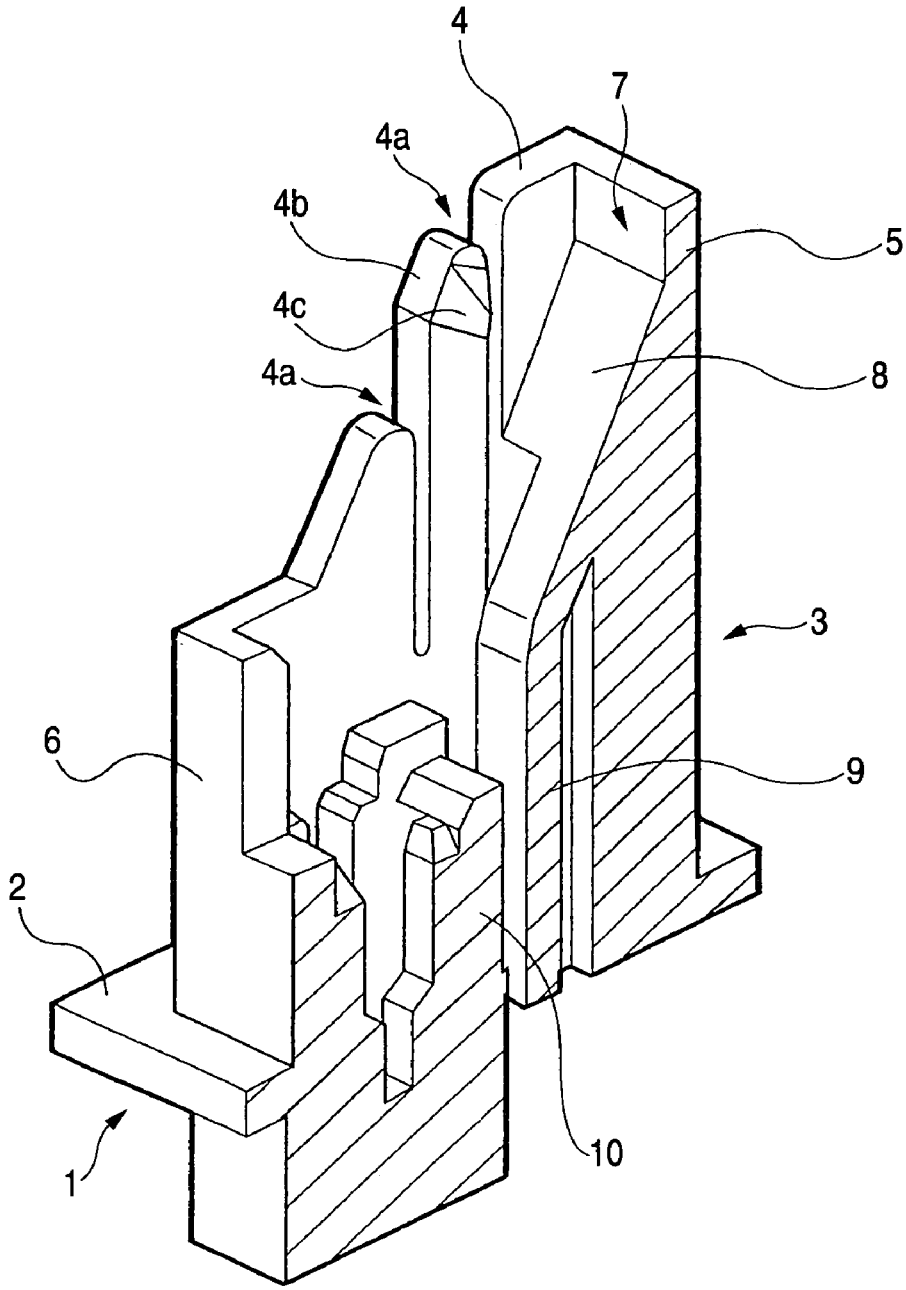
FIG. 2 is a perspective view, partially sectioned in a vertical direction, which shows an insertion port and individual portions of the fuse block.

As shown in FIGS. 1, 2, the invention provides a fuse block 3 having an insertion port 7 into which a dark current fuse 11 is inserted and adapted to hold the dark current fuse 11 in a mount position, the fuse block including a guide surface 8 which is formed within the insertion port 7 in such a manner as to continue from the mount position for the dark current fuse 11 for contact with the dark current fuse 11 and arms 4*b* formed at positions lying at lateral sides of the dark current fuse 11 in such a manner as to face the insertion port 7 so as to be able to hold the dark current fuse therein when the dark current fuse 11 is in contact with the guide surface 8.

Figure 3:
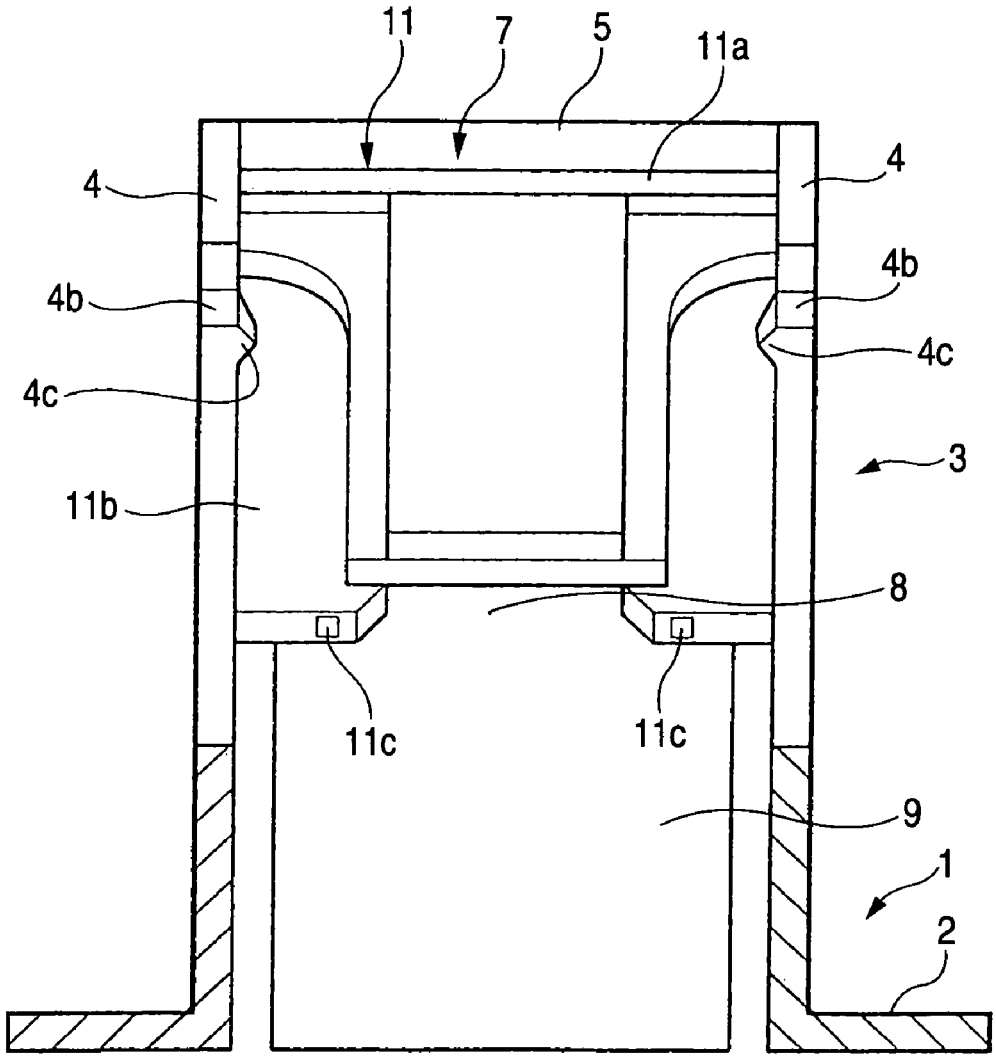
FIG. 3 is a sectional view taken along the line x-x in FIG. 1, which shows a state in which the dark current fuse is temporarily held by arms.

The mount position of the dark current fuse 11 is a position where terminals 11*c*, shown in FIG. 3, at a lower end of the dark current fuse 11 are connected to connecting terminals accommodated within the fuse block 3, and when the dark current fuse 11 is in contact with the guide surface 8, it means that the dark current fuse 11 is in a temporary hold state. FIG. 1 shows the temporary hold state of the dark current fuse 11.

The dark current fuse 11 has a head portion 11*a* and a body portion 11*b*, and the dark current fuse 11 is brought into contact with the guide surface 8 on one side of the body portion 11*b* in a thickness direction thereof and is brought into contact with an inner wall 9, which will be described later on, in the mount state. The dark current fuse 11 is inserted into the insertion port 7 with its lateral direction oriented in a direction in which the dark current fuse 11 so inserted faces widthways side walls 4, 4, which will be described later on, of the fuse block 3.

The fuse block 3 is, as shown in FIGS. 1, 2, formed into a box shape integrally with part of a base plate 2 of an electric junction box 1. The fuse block 3 is fabricated from synthetic resin or the like together with the base plate 2 while including as basic constituent elements the side walls 4, 4 which face each other across the dark current fuse 11 widthways, a rear wall 5 which intersects the side walls 4, 4 at right angles to connect the side walls 4, 4 together and which is adapted to support the dark current fuse 11 in the temporary hold state, and a front wall 6 which faces the rear wall 5. The side walls 4, 4, the rear wall 5 and the front wall 6 are provided on the base plate 2 in such a manner as to erect therefrom to make up vertical sides of the fuse block 3, and the insertion port 7, which is opened at a top thereof, is formed by these walls. FIG. 2 shows a sectional view of the fuse block 3 in which the dark current fuse 11 is not present.

As shown in FIG. 2, an inner circumferential surface of the rear wall 5 makes up the guide surface 8 with which the one side of the body portion 11*b* of the dark current fuse 11 is brought into contact, and the inner wall 9 is formed in such a manner as to continue to the guide surface 8 so as to hold the dark current fuse 11 in the mount position thereof. A securing wall 10 is formed at an opposite position to the inner wall 9 in such a manner as to form a pair with the inner wall 9 so as to hold the dark current fuse 11 in the mount position together with the inner wall 9. The guide surface 8 is inclined relative to the surface of the inner wall 9 which constitutes a vertical plane or a plane which is almost vertical in the figure, whereby the height of a top portion of the fuse block 3 from the base plate 2 is suppressed, and the load to be borne by the arms 4*b* which hold the dark current fuse 11 is reduced.

A distance between respective opposing surfaces of the inner wall 9 and the securing wall 10 is such as to correspond to the thickness of the body portion 11*b* of the dark current fuse 11 and is actually equal to or slightly smaller than the thickness of the body portion 11*b*. In the event that the distance is slightly smaller than the thickness of the body portion 11*b*, at least either of the inner wall 9 and the securing wall 10 is made to be deformed elastically so as to catch and hold the dark current fuse 11 in the thickness direction therebetween in the mount position.

In FIG. 2, the inner wall 9 is made to continue to part of the rear wall 5 which makes up the guide surface 8 and an end of the inner wall 9 which lies to the base plate 2 is cut apart from the base plate 2 so as to impart an elastic deformation capability to the inner wall 9. In this event, the dark current fuse 11 is made to fall into the insertion port 7 while caught between the inner wall 9 and the securing plate 10 at the body portion 11*b* thereof, and being deformed towards the rear wall 5 at a portion closer to the lower end thereof, the inner wall 9 catches and restrains the body portion 11*b* of the dark current fuse 11 in the thickness direction.

An upper portion of the rear wall 5 than the guide surface 8 erect to form a vertical surface to the base plate 2 so as to protect the dark current fuse 11 from an external force together with upper portions of the side walls 4 than the guide surface 8 while the dark current fuse 11 is in the temporal hold state in which the fuse is in contact with the guide surface 8, the safety of the dark current fuse 11 being thereby secured.

Two notches 4*a*, 4*a* are formed partially into each side wall 4 from an upper end thereof, so that an arm 4*b* is formed which is divided, from other portions of the side wall 4 by the notches 4*a*, 4*a* so formed. In the figure, while the two notches 4*a* are made in parallel with each other in such a manner as to become vertical to the base plate 2 of the electric junction box 1, this is not always the case, and there may be a case where the notches 4*a* are made obliquely relative to the direction vertical to the base plate 2.

Since the arms 4*b* are divided from the other portions of the side walls 4, the side walls 4, 4 are enabled to be deformed elastically in opposite directions at upper ends thereof. When the dark current fuse 11 is inserted, the side walls 4, 4 contact lateral sides of the dark current fuse 11 so inserted to thereby be deformed outwards relative to the insertion port 7 while exhibiting inward restoration force, so as to hold widthways the dark current fuse 11 in the temporary hold state by the restoration force so exhibited. A distance between respective opposing inner circumferential surfaces of the arms 4*b*, 4*b* is slightly smaller than the width of the body portion 11*b* of the dark current fuse 11 so that the arms 4*b*, 4*b* can be deformed outwards when the dark current fuse 11 is inserted. The arms 4*b* are formed at positions where they can catch therebetween widthways any portion of the body portion 11*b* of the dark current fuse 11 when the fuse is in the temporary hold state.

A projection 4*c* is formed on at least either of surfaces of the arms 4*b*, 4*b* which face each other in such a manner as to project towards the dark current fuse 11 so as to catch and hold the dark current fuse 11 in the thickness direction together with the guide surface 8. A surface or point (including a line) on a side of the projection 4*c* which lies to the guide surface 8 is or can be brought into contact with a surface of the body portion 11*c* of the dark current fuse 11 which is in the temporary hold state, so as to prevent the floating of the dark current fuse 11 through a contact so made.

In the figure, while the projection 4*c* is formed at an upper end portion of each of the arms 4*b*, 4*b*, since the position of the projections 4*c* is determined by the position of the body portion 11*b* of the dark current fuse 11 which is in the temporary hold position, there may occur a case where the projection 4*c* is formed at an intermediate portion in a height direction of the arm 4*b*. In addition, since the projections 4*c* play a role of assisting the two arms 4*b*, 4*b* to restrain the dark current fuse 11 widthways, there may occur a case where the projection 4*c* only has to be formed on either of the arms 4*b*.

The surface or point on the side of the projection 4*c* which lies to the guide surface 8 and the guide surface 8 are spaced apart from each other an interval corresponding to the thickness of the body portion 11*b* of the dark current fuse 11 so that the dark current fuse 11 can be caught and held in the thickness direction between the projection 4*c* and the guide surface 8 when it is in the temporary hold state. In the event that the interval is slightly smaller than the thickness of the body portion 11*c*, since the arm 4*b* is deformed in the thickness direction of the dark current fuse 11 to thereby generate the restoration force when the projection 4*c* is brought into contact with the surface of the body portion 11*c*, the arm 4*b* exhibits an effect to secure the dark current fuse 11 towards the guide surface 8.

Figure 4:
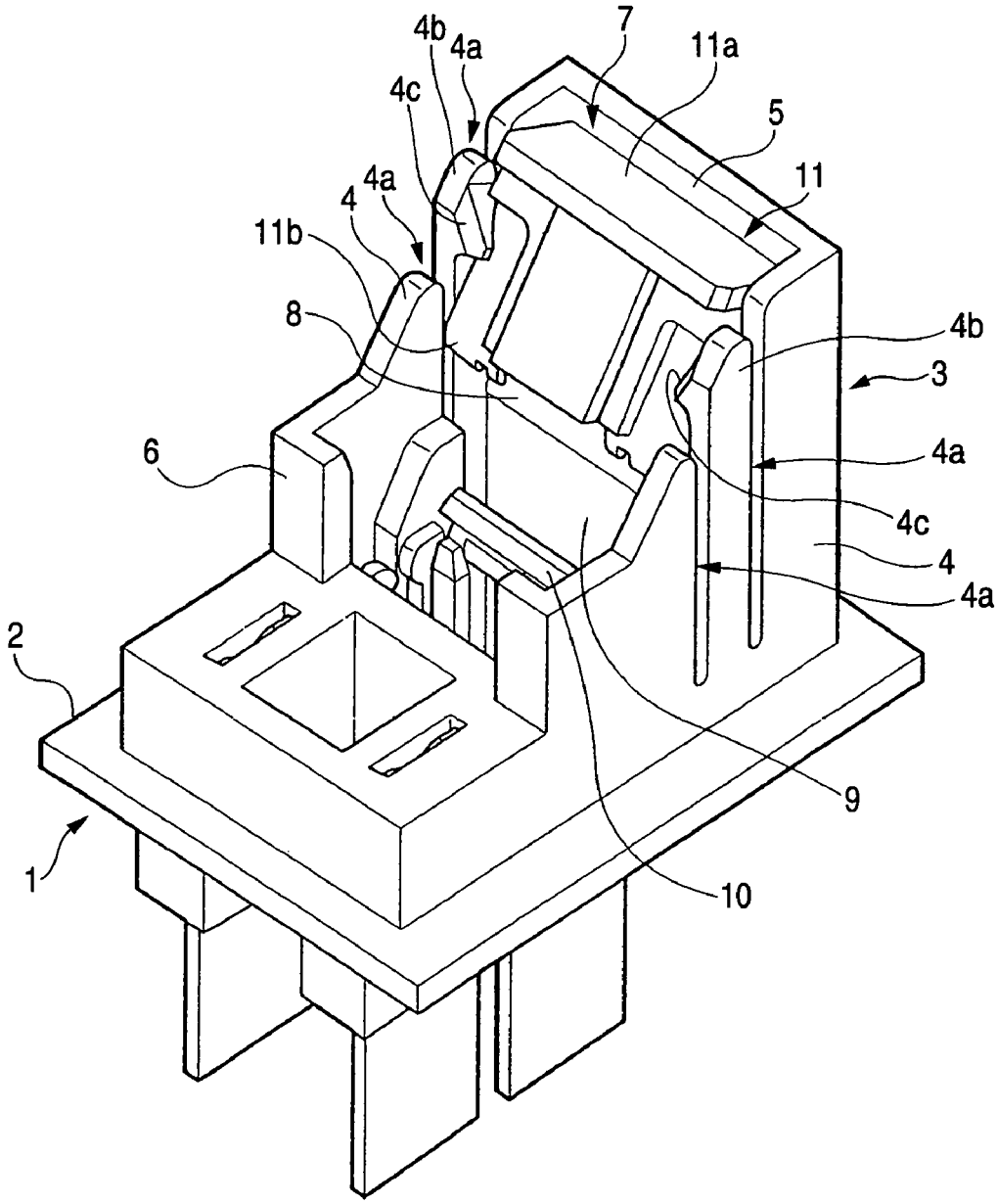
FIG. 4 is a perspective view which shows a state in which the dark current fuse is temporarily held in a fuse block having arms on which projections are formed which are different in shape from those shown in FIG. 1.

As shown in FIG. 4, the projections 4*c* are or can be brought into contact with the surface of the body portion 11*b* at lateral end positions of the body portion 11*b*, and when the dark current fuse 11 is shifted to the mount position, the arms 4*b* are deformed outwards so as to ride over the head portion 11*a* of the dark current fuse 11 which is being shifted. FIG. 4 shows a case where a fuse block 3 is used which has arms 4*b* on which projections 4*c* are formed which are different in shape from those on the fuse block 3 shown in FIG. 1.

When the dark current fuse 11 is inserted, the dark current fuse 11 is inserted from above the fuse block 3 along the guide surface 8, and the body portion 11*c* is caught by the guide surface 8 and the projections 4*c*. The rear side of the body portion 11*c* is brought into contact with the guide surface 8, while the front surface of the body portion 11*b* is or can be brought into contact with the projections 4*c*. At the same time, both the lateral sides of the body portion 11*b* are brought into contact with the other portions of the opposing arms 4*b*, 4*b* than the projections 4*c* to thereby be given compression force from the arms 4*b*, 4*b* which results from the restoration force thereof, whereby the dark current fuse 11 is held by both the arms 4*b*, 4*b*, resulting in the temporary hold state. As this occurs, upper surfaces or points of the projections 4*c* are brought into contact with a lower surface of the head portion 11*a* as shown in FIG. 3, resulting in a state where the dark current fuse 11 is locked downwards on the projections 4*c* at the head portion 11*a* thereof FIG. 3 is a sectional view taken along the line x-x in FIG. 1.

The temporary hold state of the dark current fuse 11 is released when the dark current fuse 11 is pushed downwards further from a state shown in FIG. 1, so that both lateral sides of the head portion 11*a* ride over the projections 4*c*, respectively. The dark current fuse 11 is made to continue to fall between the internal wall 9 and the securing wall 10, and by virtue of elastic deformation of at least either of the inner wall 9 and the securing wall 10, the dark current fuse 11 is held by both the inner wall 9 and the securing wall 10 by the restoration force resulting from the elastic deformation, whereby the dark current fuse 11 is put in the mount state where the terminals 11*c* of the dark current fuse 11 are connected to the connecting terminals.

The release of the dark current fuse 11 from the mount state is effected by gripping the sides of the head portion 11*a* or the body portion 11*b* of the dark current fuse 11 using a coupler or the like so as to simply pull up the dark current fuse 11.

What is claimed is:

1. A fuse block, comprising an insertion port into which a dark current fuse is inserted and adapted to hold the dark current fuse in a mount position, the fuse block comprising:

a guide surface, with which the dark current fuse is brought into contact, formed within the insertion port and continued from the mount position;

arms, formed at positions lying at lateral sides of the dark current fuse and facing the insertion port so as to hold the dark current fuse therein when the dark current fuse is brought into contact with the guide surface, wherein the guide surface is configured to hold the dark current fuse in an inclined position.

2. The fuse block according to claim 1, wherein a distance between respective inner circumferential surfaces of the opposing arms is slightly small than a width of a portion of the dark current fuse held by both the arms.

3. The fuse block as set forth in claim 1, wherein a projection adapted to catch and hold the dark current fuse in a thickness direction thereof in cooperation with the guide surface is formed on a surface of at least one of the arms that opposes the other arm, so as to project towards the dark current fuse.

4. The fuse block as set forth in claim 3, wherein a distance between a surface or point on a side of the projection which lies opposite to the guide surface and the guide surface is slightly smaller than the thickness of a portion of the dark current fuse which is caught by the projection and the guide surface.

5. The fuse block as set forth in claim 1, wherein the arms are formed by making notches partially in side walls facing the insertion port.

6. The fuse block as set forth in claim 1, further comprising: an inner wall, formed at the mount position for the dark current fuse so as to hold the dark current fuse at the mount position;

wherein a surface of the inner wall is continued from the guide surface.

7. The fuse block as set forth in claim 6, further comprising: a securing wall which is able to hold the dark current fuse at the mount position in cooperation with the inner wall;

wherein a distance between respective opposing faces of the inner wall and the securing wall is slightly smaller than the thickness of a portion of the dark current fuse which is caught be the inner wall and the securing wall, and wherein at least either of the inner wall and the securing wall can be deformed elastically.

8. The fuse block as set forth in claim 6, wherein the guide surface is inclined relative to the surface of the inner wall.

9. A fuse block, comprising an insertion port into which a dark current fuse is inserted and adapted to hold the dark current fuse in a mount position, the fuse block comprising:

a guide surface, with which the dark current fuse is brought into contact, formed within the insertion port and continued from the mount position;

arms, formed at positions lying at lateral sides of the dark current fuse and afacing the insertion port so as to hold the dark current fuse therein when the dark current fuse is brought into contact with the guide surface, wherein a projection adapted to catch and hold the dark current fuse in a thickness direction thereof in cooperation with the guide surface is formed on a surface of at least one of the arms that opposes the other arm, so as to project towards the dark current fuse, and wherein a distance between a surface or point on a side of the projection which lies opposite to the guide surface and the guide surface is slightly smaller than the thickness of a portion of the dark current fuse which is caught by the projection and the guide surface.

* * * * *